US007037144B2

(12) United States Patent
Wang et al.

(10) Patent No.: US 7,037,144 B2
(45) Date of Patent: May 2, 2006

(54) CONNECTION TERMINAL UNIT FOR ANTENNA AND MANUFACTURING METHOD OF CONNECTION TERMINAL UNIT FOR ANTENNA

(75) Inventors: Jinsong Wang, Kawasaki (JP); Hiroyuki Maeda, Zama (JP)

(73) Assignee: Harada Industry Co., Ltd., Tokyo (JP)

( * ) Notice: Subject to any disclaimer, the term of this patent is extended or adjusted under 35 U.S.C. 154(b) by 170 days.

(21) Appl. No.: 10/459,197

(22) Filed: Jun. 11, 2003

(65) Prior Publication Data

US 2003/0228806 A1 Dec. 11, 2003

(30) Foreign Application Priority Data

Jun. 11, 2002 (JP) ..... 2002-169835
Jun. 25, 2002 (JP) ..... 2002-184547
Oct. 21, 2002 (JP) ..... 2002-305951

(51) Int. Cl.
*H01R 13/405* (2006.01)
*H01Q 1/24* (2006.01)

(52) U.S. Cl. ..... 439/736; 439/874; 439/916; 343/702; 343/713

(58) Field of Classification Search ..... 439/736, 439/874, 604, 608, 916; 343/702, 704, 713, 343/715; 174/87
See application file for complete search history.

(56) References Cited

U.S. PATENT DOCUMENTS 4,490,003 A * 12/1984 Robinson ..... 439/325
6,043,782 A * 3/2000 Dishart et al. ..... 343/713
6,166,697 A * 12/2000 Granqvist et al. ..... 343/702
6,310,586 B1 * 10/2001 Takahashi et al. ..... 343/872
6,445,350 B1 * 9/2002 Takenobu ..... 343/713

* cited by examiner

*Primary Examiner*—Hien Vu
(74) *Attorney, Agent, or Firm*—Ohlandt, Greeley, Ruggiero & Perle L.L.P

(57) ABSTRACT

A connection terminal unit for an antenna, which is connected to a connection terminal of the antenna, comprises a connection cord which feeds power to the antenna and transmits a signal received by the antenna, a terminal portion having a first end attached to one end of the connection cord and a second end, and a mold member formed to cover the terminal portion and a part of the connection cord, and the mold member has a thin-plate bottom portion and a plurality of island-shaped portions molded integrally with the bottom portion and spaced at appropriate intervals, and the second end of the terminal portion is exposed from the bottom portion.

7 Claims, 6 Drawing Sheets

CONNECTION TERMINAL UNIT FOR ANTENNA AND MANUFACTURING METHOD OF CONNECTION TERMINAL UNIT FOR ANTENNA

CROSS-REFERENCE TO RELATED APPLICATIONS

This application is based upon and claims the benefit of priority from the prior Japanese Patent Applications No. 2002-169835, filed Jun. 11, 2002; No. 2002-184547, filed Jun. 25, 2002; and No. 2002-305951, filed Oct. 21, 2002, the entire contents of all of which are incorporated herein by reference.

BACKGROUND OF THE INVENTION

1. Field of the Invention

The present invention specifically relates to a connection terminal unit for an antenna, which is suitably used to connect a film antenna provided on a window in an automobile or the like.

2. Description of the Related Art

Recently, many automobiles, notably luxury cars have employed a film antenna composed of an antenna element pattern printed on a transparent film, in place of a rod antenna.

The film antenna is provided on, for example, the inner surface of a rear or side window. Further, various antennas are designed and sold in order to receive FM broadcasts, FM-VICS broadcasts (FM multiplexed broadcasts that provides service information for navigation systems), GPS (Global Positioning System) signals, TV VHF/UHF broadcasts, and the like. The film antenna is superior to the rod antenna, which projects out of the car, in that its wiring has only to be laid inside the car, in that it is esthetically more excellent because it involves nothing projecting inside a passenger room or out of the car, and in that it is unlikely to encounter tampering or the like.

A connection terminal unit is attached to a tip of a connection cord connected to a connection terminal pattern of the film antenna in order to load signals received by the antenna. A pressure sensitive adhesive double coated tape is provided on the back surface of the connection terminal unit so as to cover the entire surface. A connection terminal portion is arranged in a central portion of the pressure sensitive adhesive double coated tape in its central portion so as to be drawn out from the connection terminal unit. The connection terminal portion is electrically connected to the film antenna.

In such a connection terminal unit, the connection cord is guided into a resin case of the connection termination section via an opening formed in one side wall of the case. One end of the connection terminal unit is electrically connected to the tip of the connection cord by, for example, soldering.

On the other hand, an adhesive is filled into the case and then hardened to prevent air, moisture, or the like from entering the interior of the case.

Furthermore, a resin cover is fitted on the case, the resin cover having a U-shaped notch formed in association with the connection cord. The connection terminal unit thus has a box structure.

This makes the connection terminal unit unlikely to be deformed in spite of external force to prevent the entry of external moisture.

Further, some connection terminal units are known which are entirely covered with a mold member made of an insulator resin such as an ABS resin or an AES resin with only the other end of the connection terminal unit exposed.

Most windows in automobiles to which the film antenna is attached, notably front and rear windows have curved surfaces instead of flat surfaces. Accordingly, the film antenna and its connection terminal unit are desirably flexible enough to be attached to the window along its curved surface. Therefore, a sufficiently thick and elastic film antenna must be employed if it is attached to a curved surface.

Further, such a connection terminal unit generally corresponds to a solid wire. However, the solid wire corresponds only to a signal line to the antenna. This hinders an earth line from being simultaneously connected to the antenna.

If the antenna has only the signal line and no earth lines, an antenna signal received via the signal line is likely to be affected by noise. It is contemplated that an earth line may be separately connected to the antenna. However, this results in a complicated structure and increases manufacturing costs.

BRIEF SUMMARY OF THE INVENTION

According to an aspect of the invention, there is provided a connection terminal unit for an antenna which is flexible enough to avoid restricting a position or direction at or in which an antenna, notably a film antenna is attached, or the like, the connection terminal unit allowing its own thickness to be reduced.

According to another aspect of the present invention, there is provided a connection terminal unit for an antenna which can be used for a coaxial cable in which a plurality of conductors are coaxially arranged via an insulator, the connection terminal unit having a simplified structure to minimize time and effort required for manufacturing, thus reducing manufacturing costs.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

FIG. 3D is a sectional view showing this connection terminal unit;

DETAILED DESCRIPTION OF THE INVENTION

With reference to FIGS. 1A to 2C, description will be given of the structure of a connection terminal unit for an antenna according to a first embodiment of the present invention.

Figure 1A:
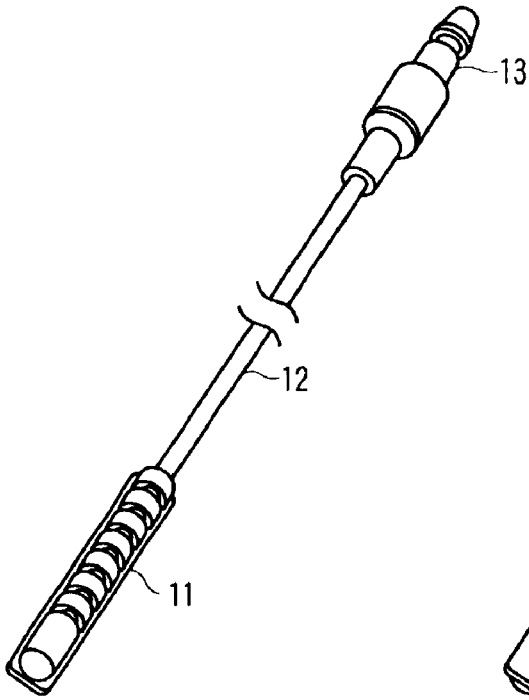
FIGS. 1A to 1C are views showing a connection terminal unit for an antenna according to a first embodiment of the present invention.
Figure 1B:
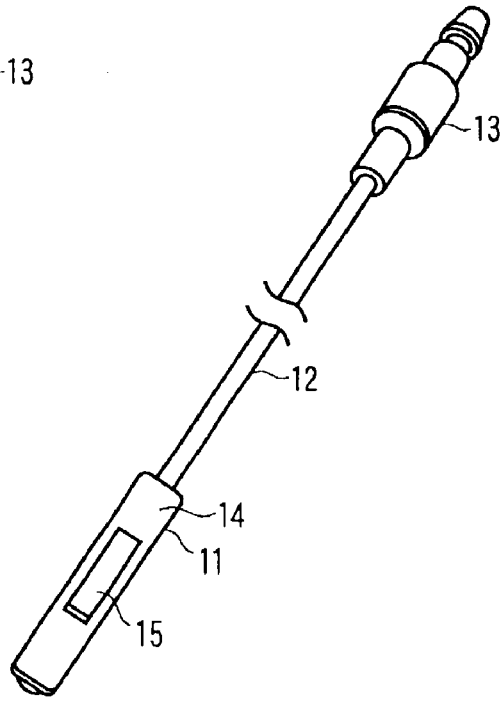

FIGS. 1A and 1B are views showing the appearance of a connection terminal unit 11 connected to a connection terminal portion of an antenna to load signals received by the film antenna and a connection cord 12 connected to the connection terminal unit 11. In the following description, for convenience, the antenna may be referred to as a "film antenna", and the connection terminal portion may be referred to as a "connection terminal pattern".

FIG. 1A is a perspective view of the connection terminal unit 11 as viewed from its front. FIG. 1B is a view showing the appearance of the connection terminal unit 11 as viewed from its back, i.e. from its gluing side that is glued to the connection terminal pattern of the film antenna. In FIGS. 1A and 1B, an antenna plug 13 is attached to an end of the connection cord 12 which is opposite its end to which the connection terminal unit 11 is attached; the antenna plug 13 is connected to an antenna terminal (not shown) of a receiver. The antenna plug 13 is not a characteristic portion of the present invention but is common. Thus, its description will be omitted below.

As shown in FIG. 1B, a pressure sensitive adhesive double coated tape 14 is provided on the back surface of the connection terminal unit 11 so as to cover the entire back surface. A connection terminal plate 15 is arranged in a central portion of the back surface of the connection terminal unit 11 so as to be electrically connected to the film antenna.

Figure 1C:
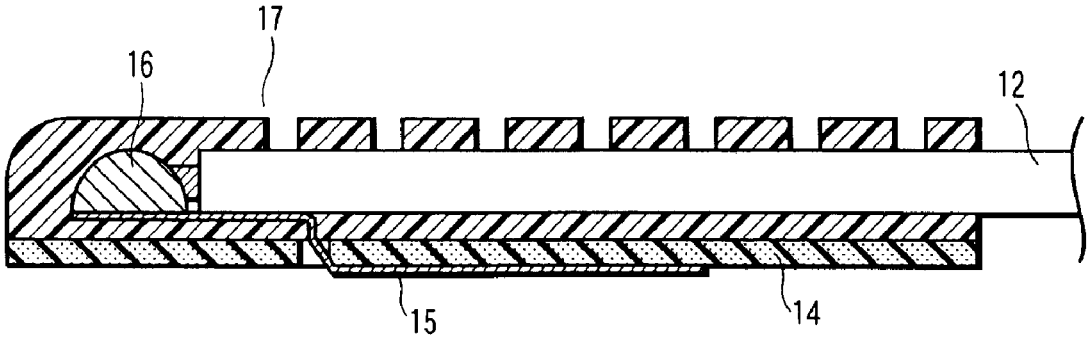

FIG. 1C is a view showing the sectional structure of the connection terminal unit 11. FIG. 1C shows that (a conductor portion of) the connection cord 12 is soldered to the connection terminal plate 15 and thus arranged at the tip of the connection terminal unit 11. The tip is covered with a mold member 17. The mold member 17 covers the whole connection terminal unit 11 except for one part so as to make the section 11 flexible. Specifically, the mold member 17 has a bottom portion and a cord holding portion which are integrally molded, the cord holding portion being shaped like a multistage ring. The bottom portion of the mold member 17 is formed like a thin plate that extends so that the tip of the connection cord 12 can be placed on the bottom portion. The cord holding portion comprises a plurality of ring-like portions spaced at appropriate intervals, to corporate with the bottom portion in holding the tip of the connection cord 12 placed on the bottom portion. The mold member 17 is preferably composed of an insulating resin such as an ABS resin or an AES resin.

In the configuration of the cord holding portion of the connection terminal unit 11, the multistage ring-like members are spaced at the intervals as described above. Consequently, the casing of the connection cord 12 is partly exposed. A solder 16 or the like in the tip is sealed by the mold member 17 in the tip in order to reliably prevent external moisture from entering the connection section.

The pressure sensitive adhesive double coated tape 14 is provided on that surface of the bottom portion of the mold member 17 which is connected to the connection terminal pattern of the film antenna. Further, the connection terminal plate 15 drawn out from the bottom portion of the mold member 17 is arranged substantially in the center of the pressure sensitive adhesive double coated tape 14 so as to be connected to the connection terminal pattern of the film antenna.

In this case, the pressure sensitive adhesive double coated tape 14 preferably has a specified thickness and a significant cushioning property. Then, if the connection terminal unit 11 is provided on the connection terminal pattern of the film antenna, the pressure sensitive adhesive double coated tape 14 is compressed so as to absorb the thickness of the connection terminal plate 15 (this also applies to the following embodiments). Further, the elasticity of the pressure sensitive adhesive double coated tape 14 allows connection terminal plate 15 to be continuously pressed against the connection terminal pattern. Preferably, the pressure sensitive adhesive double coated tape 14 is an insulator so that the connection terminal plate 15 is isolated from the exterior. Further, the pressure sensitive adhesive double coated tape 14 may be exclusively used for the connection terminal unit or may be glued to the bottom portion of the connection terminal unit 11 before the section 11 is connected to the connection terminal pattern. Furthermore, an adhesive or the like may be used in place of the pressure sensitive adhesive double coated tape 14.

Figure 2A:
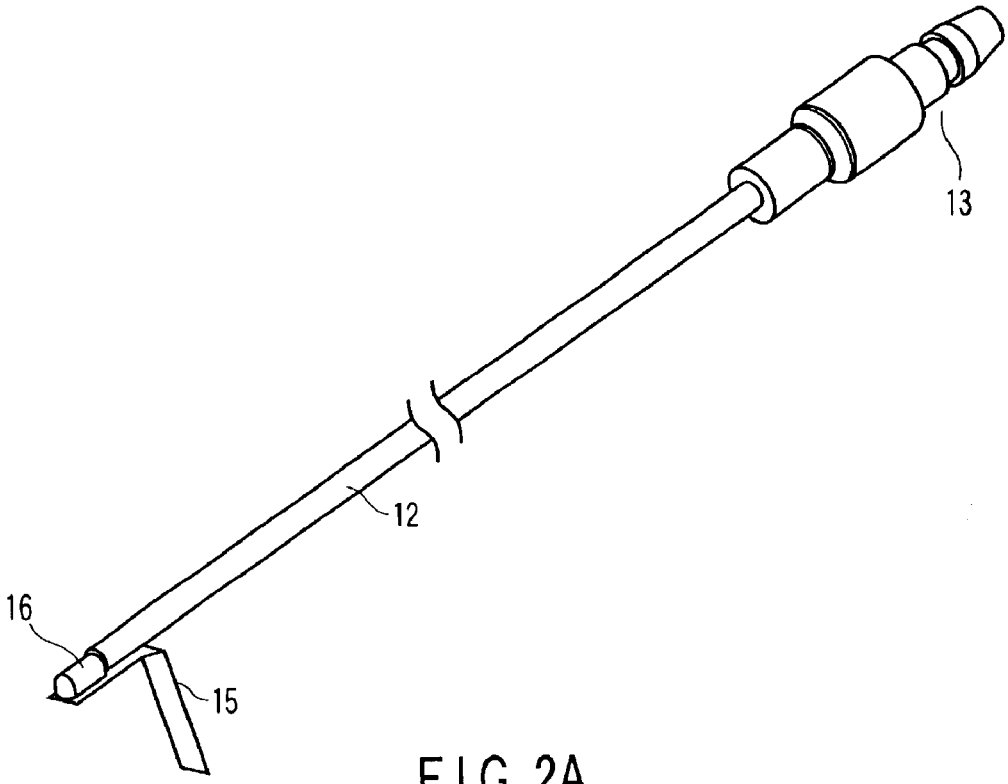
FIGS. 2A to 2C are perspective views illustrating a manufacturing process of the connection terminal unit according to the first embodiment.
Figure 2B:
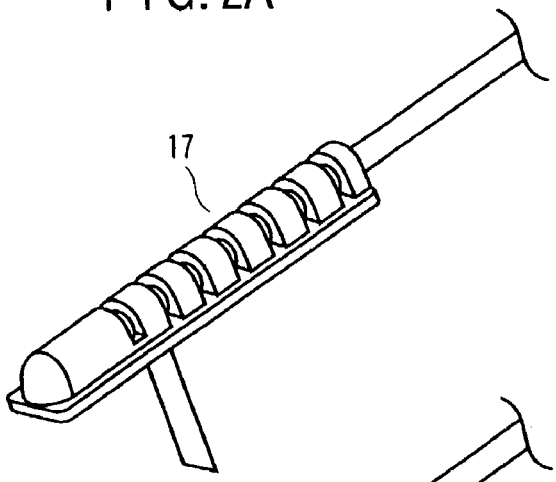
Figure 2C:
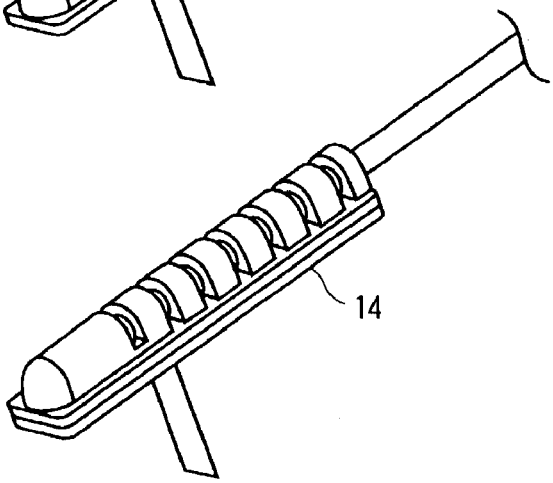

With reference to FIGS. 2A to 2C, description will be given of a manufacturing process of the connection terminal unit 11.

FIG. 2A shows that the connection terminal plate 15 is glued to one end (tip) of the connection cord 12 using the solder 16. As shown in FIG. 2A, the connection terminal plate 15 is a thin metal plate (e.g. thin copper plate) bent in L form. The outside of one side of the connection terminal plate 15 is glued to the tip of the connection cord 12 using the solder 16.

When the mold member 17 is molded integrally with the arrangement shown in FIG. 2A, an arrangement such as the one shown in FIG. 2B is obtained. At this point, the terminal connection plate 15 remains L-shaped.

When the arrangement shown in FIG. 2B is glued to one surface of the pressure sensitive adhesive double coated tape 14 that is dimensionally equal to the bottom portion of the mold member 17, an arrangement such as the one shown in FIG. 2C is obtained.

It is preferable to form a through-hole in the pressure sensitive adhesive double coated tape 14 so that the connection terminal plate 15 can penetrate the tape 14. In the condition shown in FIG. 2C, release paper is removed which is provided on that side of the pressure sensitive adhesive double coated tape 14 which is opposite the mold member 17. The connection terminal plate 15 is folded in crank form as shown in FIG. 1C and is then glued to the gluing surface of the pressure sensitive adhesive double coated tape 14. Thus, the state shown in FIGS. 1A to 1C is obtained. The connection terminal unit 11 can be provided directly on the connection terminal pattern of the film antenna to be attached.

As described above, the resin constituting the mold member 17 is flexible, and the front cord holding portion, which holds the connection cord 12, is composed of the multiple rings spaced at the appropriate intervals. This serves to minimize the total height of the connection terminal unit 11. Further, the connection terminal unit 11 can be easily deformed both upward and downward along the axial direction of the connection cord 12. The connection terminal unit 11 can thus be easily adapted to the curved shape of a windowpane of an automobile.

The tip of the mold member 17, i.e. the portion in which the corresponding end of the connection cord 12 and the connection terminal plate 15 are glued together using the solder 16 is completely sealed by the resin constituting the mold member 17. It is thus possible to reliably prevent external moisture from entering the connection section.

In the first embodiment, the end of the connection cord 12 and the connection terminal plate 15 are electrically connected together by gluing them together using the solder 16. The present invention is not limited to this aspect. For example, the end of the connection cord 12 and the connection terminal plate 15 may be connected together by a mechanical method such as calking (or a solderless terminal or the like). Further, the connection terminal plate 15 may be shaped like, for example, a rod or a line instead of the plate provided that the conductor can be removed from the mold member 17. This also applies to the following embodiments.

Furthermore, the pressure sensitive adhesive double coated tape 14 is used to adhere the connection terminal unit 11 to the connection terminal pattern of the film pattern. However, the present invention is not limited to this aspect.

With reference to FIGS. 3A to 5E, description will be given of the structure of a connection terminal unit for an antenna according to a second invention of the present invention. In the description of the first embodiment, the connection cord is a solid wire. However, in the description of the succeeding embodiments, the connection cord is a coaxial cable.

Figure 3A:
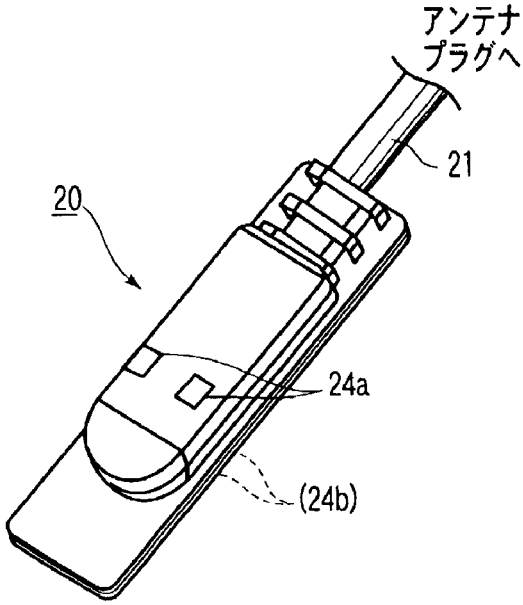
FIGS. 3A to 3D are views showing the appearance of a connection terminal unit for an antenna according to a second embodiment of the present invention.
Figure 3B:
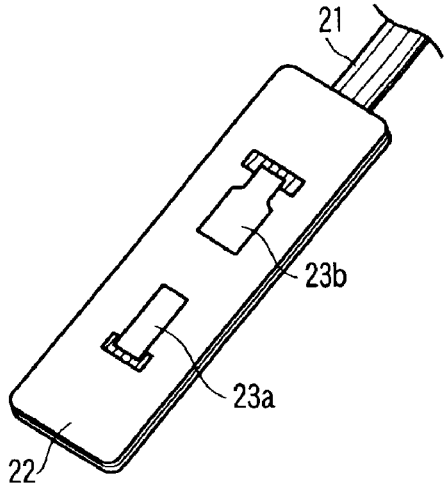
Figure 3C:
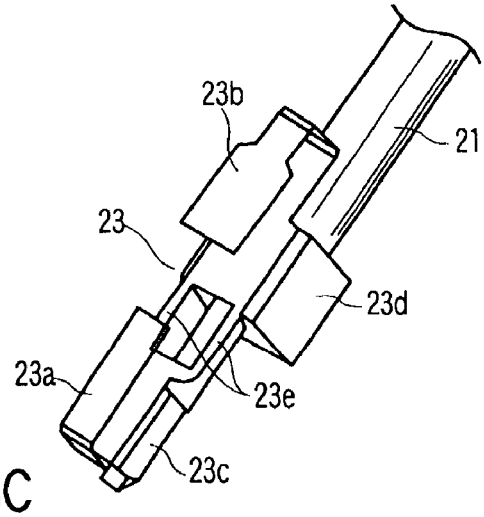
Figure 3D:
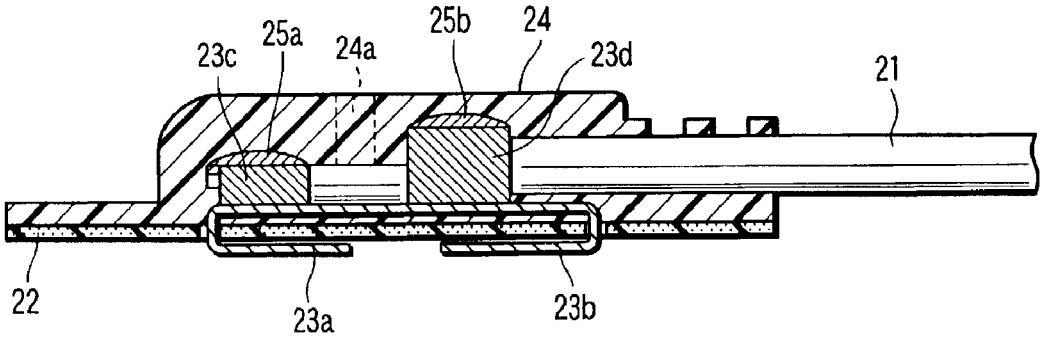

FIGS. 3A to 3C are views showing the appearance of the connection terminal unit for an antenna according to the second embodiment of the present invention, and FIG. 3D is a sectional view showing this connection terminal unit.

FIGS. 3A and 3B are views showing the appearance of a connection terminal unit 20 connected to a connection terminal pattern of an antenna to load received signals and a coaxial cable 21 used as a connection cord for the connection terminal unit 11.

FIG. 3A is a perspective view of the connection terminal unit 20 as viewed from its front. FIG. 3B is a view showing the appearance of the connection terminal unit 20 as viewed from its back, i.e. from its gluing side that is glued to the connection terminal pattern of the film antenna. In FIGS. 3A and 3B, an antenna plug is attached to an end of the coaxial cable 21 which is opposite its end to which the connection terminal unit 20 is attached, as in the case with the first embodiment; the antenna plug is connected to an antenna signal terminal (not shown) of a receiver and to an earth terminal.

As shown in FIG. 3B, a pressure sensitive adhesive double coated tape 22 is provided on the back surface of the connection terminal unit 20 so as to cover the entire back surface. A signal terminal plate 23*a* and an earth terminal plate 23*b* are arranged on a central portion of the back surface of the connection terminal unit 20 so as to be drawn out from the connection terminal unit 20 with an appropriate spacing between themselves and to be folded along the gluing surface. The signal terminal plate 23*a* and the earth terminal plate 23*b* are electrically connected to the film antenna.

FIG. 3C is a view showing that a mold member 24 constituting a casing of the connection terminal unit 20 has been removed in order to illustrate the connection between a terminal fixture 23 and a coaxial cable 21 both sealed inside the connection terminal unit 20. Further, FIG. 3D is a sectional view showing the configuration of the connection terminal unit 20 and the coaxial cable 21, including the mold member 24.

The terminal fixture 23 has a central conductor holding portion 23*c* that allows a central conductor of the coaxial cable 21 to be used as an antenna signal line and an external conductor holding portion 23*d* that allows an external conductor of the coaxial cable 21 to be used as an earth line. Terminal plates 23*a* and 23*b* are drawn out from the holding portions 23*c* and 23*d*, respectively. As described later in detail, the holding portions 23*c* and 23*d* are integrally formed via a pair of cut portions 23*e* of an extremely small line width.

Further, the holding portions 23*c* and 23*d* are firmly glued to the respective conductors of the coaxial cable using solders 25*a* and 25*b*. The holding portions 23*c* and 23*d* and the conductors of the coaxial cable may be connected together by calking as described in the first embodiment.

The mold member 24 integrally seals the corresponding end of the coaxial cable 21 and the terminal fixture 23, except for the terminal plates 23*a* and 23*b* (this sealed portion is referred to as a "cover portion"). Further, the mold member 24 is preferably composed of a flexible insulating resin such as an ABS resin or an AES resin. Although not shown in FIGS. 3A to 3D, to further improve the flexibility of the portion sealed by the mold member 24, a plurality of ring-like portions may be provided so as to cover the holding portions 23*c* and 23*d* as in the case with the first embodiment.

Further, multistage ring-like flexible portions are formed on that side of the mold member 24 which is separate from the cover portion and to which the coaxial cable 21 is attached, so as to be arranged at appropriate intervals. The flexibility of the multistage ring-like flexible portions absorbs the difference between the angle at which the connection terminal unit 20 is attached and the angle at which the coaxial cable 21 is installed. This prevents only part of the coaxial cable 21 from being bent.

Further, through-holes 24*a* and 24*b* are formed in the cover portion and bottom portion of the mold member 24 in association with the cut portions 23*e* of the terminal fixture 23. Thus, the cut portions 23*e* are exposed from the through-holes 24*a* and 24*b*, respectively. Then, while molding the mold member 24, a tool (not shown) may be inserted through each of the through-holes 24*a* and 24*b*, and the corresponding cut portion 23*e* may be cut. Consequently, the conductors of the coaxial cable 21 can be surely insulated from each other in the terminal fixture 23.

Figure 4A:
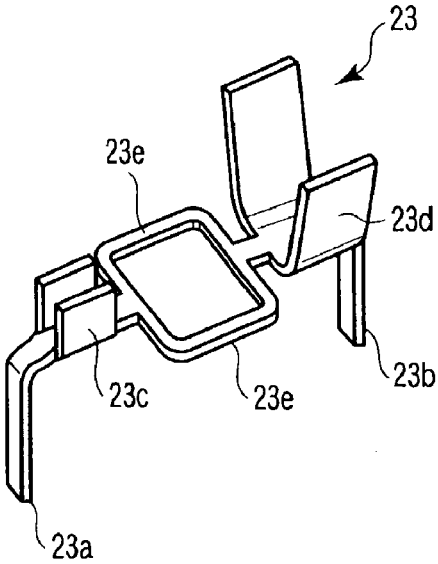
FIGS. 4A and 4B are views showing a terminal fixture and a coaxial cable attaching structure for the connection terminal unit for an antenna according to the second embodiment of the present invention.
Figure 4B:
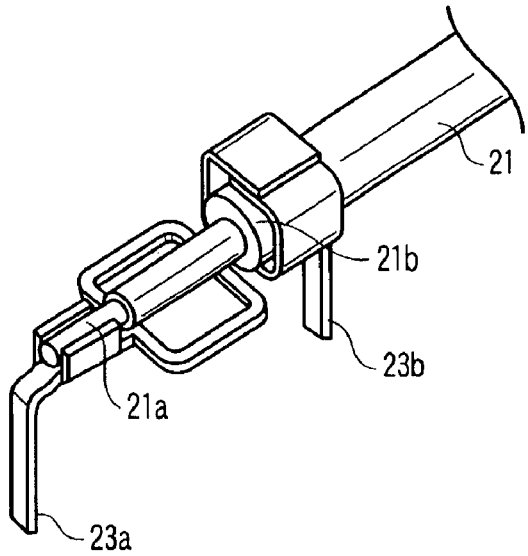

FIGS. 4A and 4B are views showing configurations of the terminal fixture 23 and the coaxial cable 21, the end of which is attached to the terminal fixture 23. The terminal fixture 23 is configured as follows:

As shown in FIG. 4A, the central conductor holding portion 23*c* and external conductor holding portion 23*d* of the coaxial cable are connected together across the pair of cut portions 23*e*, which are arranged parallel with each other with spacing maintained between them. The terminal plate 23*a*, corresponding to the central conductor holding portion 23*c*, and the terminal plate 23*e*, corresponding to the external conductor holding portion 23*d*, extend integrally from the holding portions 23*c* and 23*d*, respectively.

The terminal fixture 23 is constructed by using a pressing process to pattern-draw a thin copper plate or a thin aluminum plate and folding the plate so that the holding portions 23*a* and 23*d* are located opposite the signal terminal plate 23*a* and the earth terminal plate 23*e*. Specifically, the signal terminal plate 23*a* and earth terminal plate 23*b*, located at the respective ends of the thin metal plate, are bent at an angle of substantially 90°. Then, the central conductor holding portions 23*c*, 23*c* and the external conductor holding portions 23*d*, 23*d* are also bent at an angle of substantially 90° in a direction opposite to that in which the terminal plates 23*a* and 23*b* are bent.

As shown in FIG. 4B, the coaxial cable 21 from which a central conductor 21*a* and an external conductor 21*b* are exposed is attached to the terminal fixture 23. Then, the external conductor 21 is fixed to the terminal fixture 23 by inwardly calking or soldering the holding portions 23*c* and 23*d* of the terminal fixture 23, or inwardly calking and then soldering them, or performing other operations.

Now, with reference to FIGS. 5A to 5E, description will be given of a method of manufacturing the connection terminal unit 20.

Figure 5A:
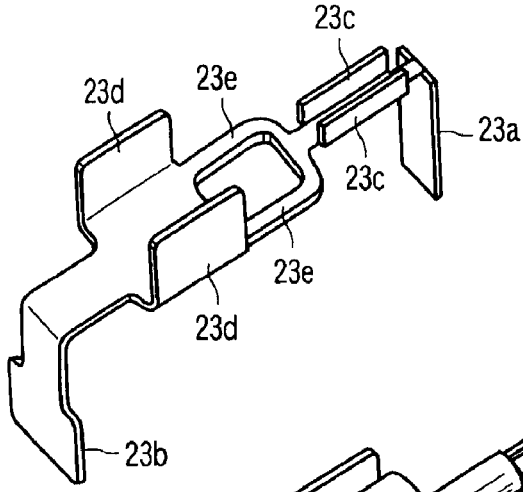
FIGS. 5A to 5E are views showing a process of assembling the connection terminal unit according to the second embodiment.
Figure 5B:
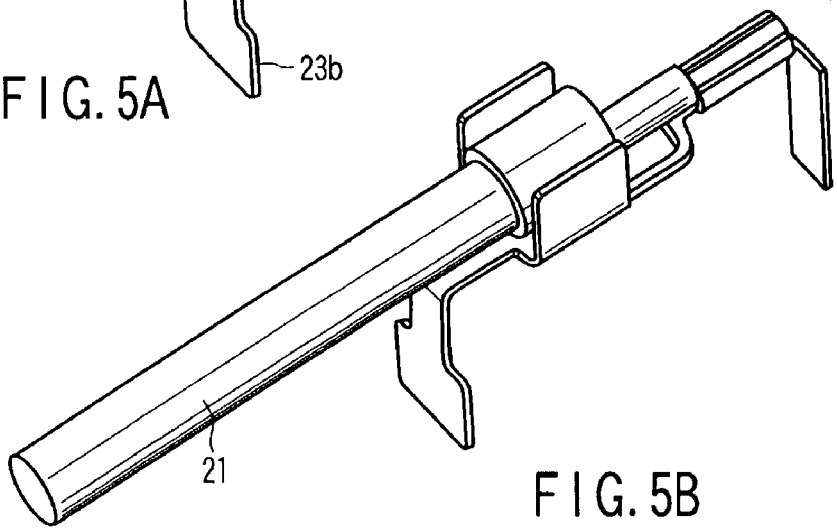

The configuration of the connection terminal unit in FIG. 5A is similar to that in FIG. 4A. Thus, its description is omitted. As shown in FIG. 5B, the coaxial cable 21 from which the central and external conductors are exposed is abutted against the terminal fixture shown in FIG. 5A. In this condition, the external conductor 21 is fixed to the terminal fixture 23 as in the case with FIG. 4B.

Figure 5C:
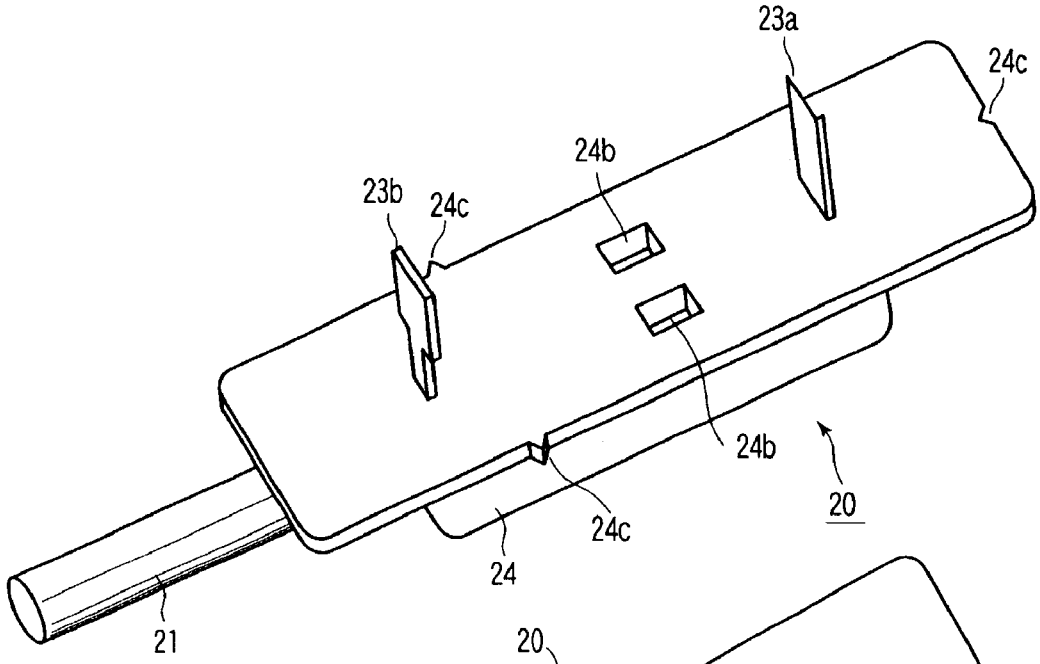
Figure 5D:
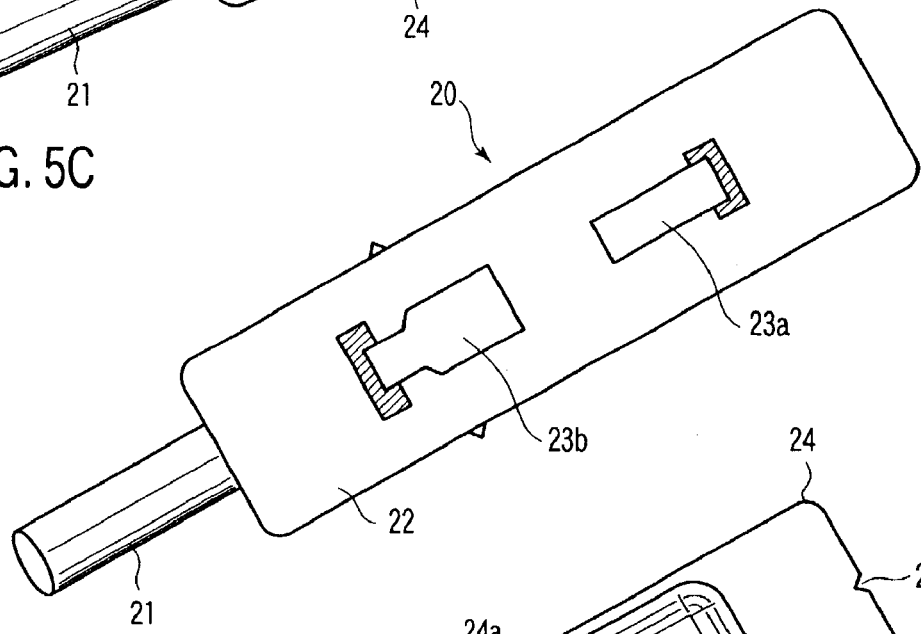
Figure 5E:
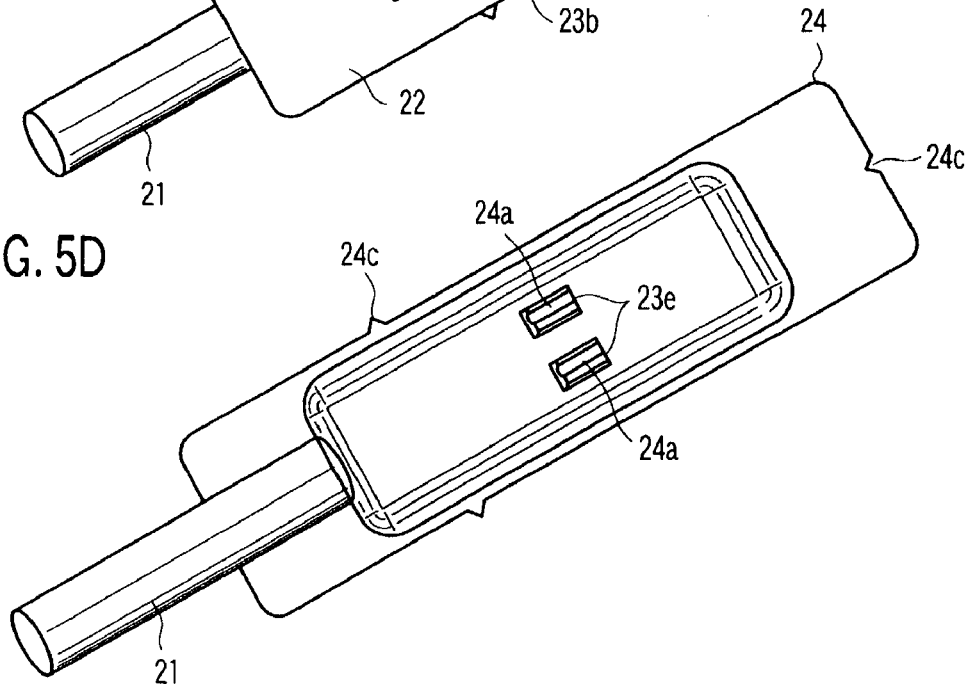

Subsequently, by molding the mold member 24 using a mold process, the connection terminal unit 20, shown in FIG. 5C, is formed. FIG. 5C is a perspective view of the mold member 24 as viewed from its bottom portion. In FIG. 5C, the terminal plates 23*a* and 23*b* have not been bent yet. Furthermore, the pressure sensitive adhesive double coated tape 22 has not been provided yet. Thus, the through-holes 24*b* are visible.

Triangular concaves and convexes formed around the periphery of the bottom portion of the mold member are positioning marks 24*c* corresponding to, for example, triangular symbols printed in the connection terminal pattern of the film pattern and used to adhere and connect the connection terminal unit 20 to the connection terminal pattern of the film antenna. Using the positioning marks 24*c*, formed in the three of the four sides of the mold member, the terminal plates 23*a* and 23*b* of the terminal fixture 23 on the connection terminal unit 20 side can be substantially accurately provided and connected to corresponding positions of the film antenna.

Subsequently, the pressure sensitive adhesive double coated tape 22 is provided on the bottom portion of the mold member 24, and the terminal plates 23*a* and 23*b* are bent along the surface of the pressure sensitive adhesive double coated tape 22. This results in the condition shown in FIG. 5D.

At this time, if the cut portions 23*e* of the terminal fixture 23 have not been cut, when the through-hole 24*a* is viewed from the top surface of the mold member 24, the cut portion 23*e* can be seen in the hole.

Accordingly, by inserting a tool through the through-hole 24*a* and cutting the corresponding cut portion 23*e*, the members corresponding to the conductors of the coaxial cable 21 can be insulated from each other in the terminal fixture 23.

Thus, the connection terminal unit 20 can be easily manufactured by using one terminal fixture 23 to attach the connection terminal unit 20 to the coaxial cable 21 and molding the mold member 24. Consequently, various costs can be reduced using the very simple configuration.

In the description of the second embodiment, the through-holes 24*a* and 24*b* are formed in the cover portion and the bottom portion, respectively, in association with the cut portions 23*e*, respectively, of the terminal fixture 23. The present invention is not limited to this aspect. It is possible to form only the through-hole 24*b* in the bottom portion without forming the through-hole 24*a* in the cover portion and inserting the tool through the through-hole 24*b* to cut the corresponding cut portion 23*e* before adhering the pressure sensitive adhesive double coated tape 22.

In this case, the through-hole 24*b* is subsequently closed by adhering the pressure sensitive adhesive double coated tape 22 to the bottom portion of the mold member 24. It is thus possible to hinder moisture from entering the through-hole 24*b*, to prevent the terminal fixture 23 from being rusted or short-circuited. In the second embodiment, the through-hole 24*b* has a rectangular cross section. However, the shape of the cross section may be a circle or the like. The through-hole 24*b* may have any shape provided that the tool can be inserted through the through-hole 24*b* to cut the corresponding cut portion 23*e*.

Figure 6A:
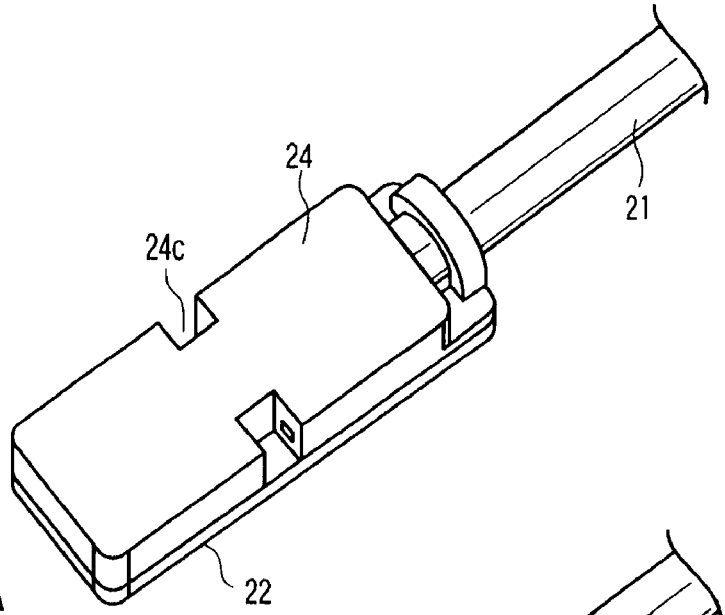
FIGS. 6A and 6B are views showing the appearance of the connection terminal unit for an antenna according to the second embodiment of the present invention.
Figure 6B:
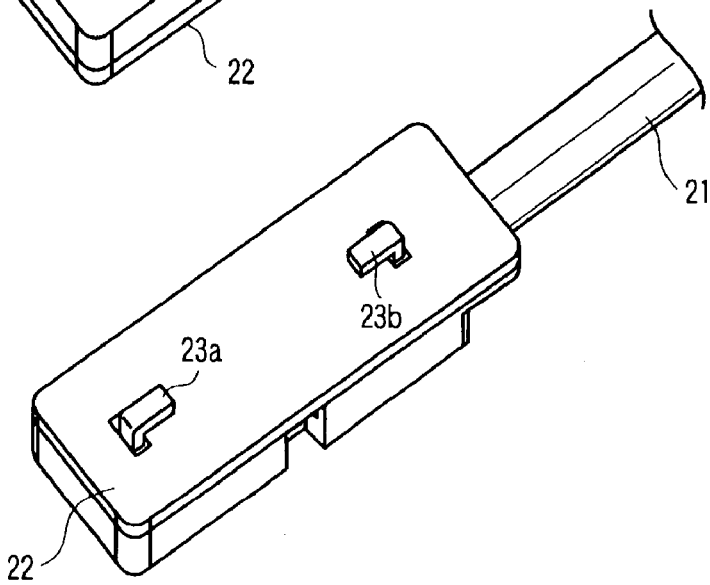

With reference to FIGS. 6A and 6B, description will be given of the structure of a connection terminal unit for an antenna according to a third embodiment of the present invention. In the third embodiment, the same components as those in the second embodiment are denoted by the same reference numerals. Their description is thus omitted.

As in the case with the second embodiment, in the third embodiment, the external conductor 21 (coaxial cable) is first fixed to the single terminal fixture 23. Then, the connection between the terminal fixture 23 and the external conductor 21 is covered with the mold member 24.

The third embodiment is characterized in that as shown in FIGS. 6A and 6B, the notch portions 24*b* are formed in place of the through-holes 24*b* according to the second embodiment. The terminal fixture 23 is configured similarly to that in the second embodiment. Its description is thus omitted. The rectangular notch portions 24*b* are formed at positions corresponding to the cut portions 23*e* of the terminal fixture 23. Accordingly, the cut portions 23*e* are exposed from the corresponding notch portions 24*b*.

Therefore, the connection terminal unit 20 can be produced as shown in FIGS. 6A and 6B, by cutting the cut portions 23*e* exposed from the corresponding notch portions 24*b* after the mold member 24 has been formed.

The cut portions 23*e* may be cut using, for example, a nipper, a common tool, or an exclusive tool that enables the pair of cut portions 23*e* to be simultaneously cut at both ends during a manufacturing process.

Therefore, if the antenna to which the connection terminal unit 20 for an antenna is to be connected is configured so that, for example, an antenna element pattern is printed on a substrate of a rigid structure, the connection terminal unit 20 is completely attached by fixing the terminal plates 23*a* and 23*b* of the connection terminal, by, for example, soldering, to a terminal connection portion expected to be provided at an end of the substrate.

Further, if the connection target is a film antenna comprising an antenna element pattern printed on a flexible transparent resin film, as shown in FIGS. 6A and 6B, the pressure sensitive adhesive double coated tape 22 having holes through which the terminal plates 23*a* and 23*b* are inserted is provided on the bottom surface of the mold member 24. Then, the terminal plates 23*a* and 23*b* are, for example, bent inward along the surface of the pressure sensitive adhesive double coated tapes 22. Thus, the connection terminal unit 20 is completely attached by using the pressure sensitive adhesive double coated tape 22 to adhere and fix the entire bottom surface of the mold member 24 of the connection terminal to a terminal connection portion expected to be provided at an end of the film antenna.

As described above, also in the third embodiment, the connection terminal can be easily manufactured by using the single terminal fixture 23 to attach the coaxial cable 21, molding the mold member 24, and cutting the cut portions 23*e* exposed from the corresponding cut portions 24*b* in the mold member 24. Therefore, various costs can be reduced using the very simple configuration.

Figure 7:
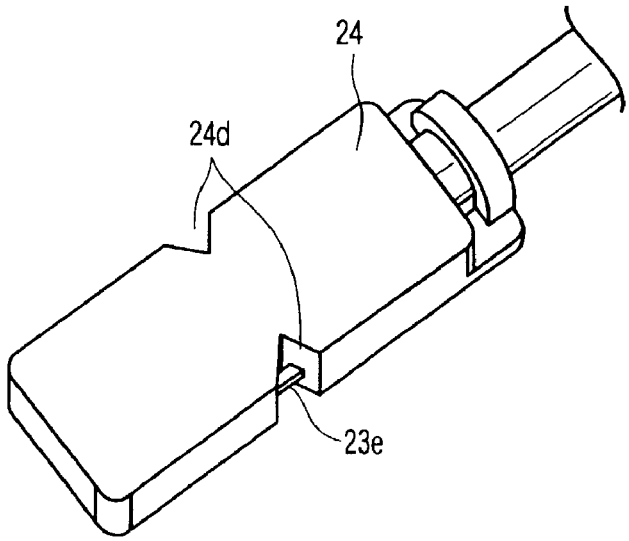
FIG. 7 is a perspective view illustrating another shape of notch portions of a mold member according to a third embodiment.

In the description of the third embodiment, the notch portion 24*b*, formed in the mold member 24, is rectangular. However, the present invention is not limited to this aspect. The notch portions may have any shape provided that they allow the cut portions 23*e* to be exposed and cut. For example, as shown in FIG. 7, the notch portions 24*d* may be triangular as shown in FIG. 7. Alternatively, the notch portions may have any shape such as a U shape.

In the examples shown in the second and third embodiments, the coaxial cable comprises the two coaxially arranged conductors, i.e. the central and external conductors. The present invention is not limited to this aspect but is of course applicable to a coaxial cable comprising three or more coaxially arranged conductors.

In the second and third embodiments, the terminal fixture has the two cut portions 23*e*, so that the corresponding number of through-holes 24*b* and notch portions 24*c* are formed. The present invention is not limited to this aspect. The number of cut portions 23*e* may be one or three or more. The corresponding number of through-holes 24*b* or notch portions 24*c* may be formed. Furthermore, the mold member is filled into the through-holes 24*b* and the notch portions 24*c* after the cut portions 23*e* have been cut. This serves to prevent the rusting of the cut and exposed portion or the like.

The antenna is not limited to the film antenna but a case where the terminal unit is connected with the film antenna for convenience' sake as above-mentioned explanation. The connection terminal according to the embodiment of the present invention can be applied to any antenna which comprises the terminal such as the feeder terminals. In addition, in the above-mentioned explanation, the connection terminal unit and the antenna are connected by adhering and fixing with the pressure sensitive adhesive double coated tape, but may be connected with an adhere or may be connected by any the methods.

Further, the present invention is not limited to the above embodiments. Many variations may be made to these embodiments within the scope of the present invention.

Furthermore, the above embodiments include various levels of inventions. Various inventions can be extracted by properly combining a plurality of constitutional requirements together. For example, even if some of all the constitutional requirements shown in the embodiments are removed, it is possible to solve the problems described in the section for the problems to be solved by the invention. If at least one of the effects described in the section for the effects of the invention, it is possible to extract a configuration free from the removed constitutional requirements.

A connection terminal unit for an antenna, which is connected to a connection terminal of the antenna, according to a first aspect of the present invention is characterized by comprising: a connection cord which feeds power to the antenna and transmits a signal received by the antenna; a terminal portion having a first end attached to one end of the connection cord and a second end; and a mold member formed to cover the terminal portion and a part of the connection cord, wherein the mold member has a thin-plate bottom portion and a plurality of island-shaped portions molded integrally with the bottom portion and spaced at appropriate intervals, and the second end of the terminal portion is exposed from the bottom portion. The connection terminal unit can be attached to a curved surface by arranging the mold member in the form of an island to make the connection terminal unit flexible.

This connection terminal unit for an antenna is preferably configured in the manners shown below. These manners may be individually applied or any of them may be properly combined together.

(1) The mold member is made of a flexible insulating resin.

(2) Each of the island-shaped portions of the mold member comprises a half-ring-like shape and is formed to tightly contact with the terminal portion and a part of the connection cord.

(3) The bottom portion of the mold member is adhered to a connection terminal unit of the antenna, and the second end of the terminal portion is electrically connected to the connection terminal portion of the antenna.

(4) An adhering member which allows the bottom portion of the mold member to be adhered to the connection terminal unit of the antenna is further provided.

(5) The island-shaped portions of the mold member formed to cover the terminal portion are set to be longer than the island-shaped portions of the mold member formed to cover the part of the connection cord, along a cord length direction of the connection cord.

(6) The mold member is formed so as to prevent the end of the connection cord and the first end of the terminal portion from being exposed.

(7) The connection cord comprises a plurality of conductors concentrically arranged via an insulator, and the connection terminal unit further comprises a plurality of holding portions the number of which corresponds to the number of the conductors of the connection cord and at least one cut portion which is cut after the terminal portion has been covered with the mold member, in order to separate the plurality of holding portions from one another.

These manners serve to markedly reduce the total height of the connection terminal unit. Further, the place in which the antenna is installed is not restricted, and the connection terminal unit can be easily manufactured. Consequently, costs can be reduced. Furthermore, a watertight and airtight condition can be reliably ensured without impairing the flexibility of the whole connection terminal unit.

A connection terminal unit for an antenna, which connects a connection cord having a plurality of conductors concentrically arranged via an insulator to a terminal of an antenna, according to a second aspect of the present invention is characterized by comprising: a terminal fixture having a plurality of holding portions which are formed integrally with the terminal fixture via at least one cut portion and the number of which corresponds to the number of the conductors of the connection cord, the cut portion being cut after the terminal portion has been covered with the mold member, in order to separate the plurality of holding portions from one another; and a mold member having a thin-plate-like bottom surface portion and a cover portion which are integrally molded, the bottom surface portion extending along a cord length direction of the connection cord, the cover portion cooperating with the bottom surface portion in covering and holding the holding portions, the mold member being formed so that the cut portion is exposed. The cut portions of the terminal fixture can be cut after the mold member has been molded. It is thus possible to individually electrically insulate the terminal fixtures corresponding to the plurality of conductors of the coaxial cable. Consequently, the connection terminal unit can be manufactured so as to have a very simple structure while reducing various costs.

This connection terminal unit for an antenna is preferably configured in the manners shown below. These manners may be individually applicable or any of them may be properly combined together.

(1) The mold member comprises at least one of a through-hole and a notch portion from which the cut portion is exposed.

(2) Said at least one of the through-hole and the notch portion is formed only in the bottom portion of the mold member.

(3) The mold member is made of an insulator resin.

(4) The terminal fixture further comprises a plurality of connection terminal portions molded integrally with the holding portions connected to the terminal of the antenna so that the connection terminal portions can be electrically connected to the holding portions, the plurality of connection terminal portions are exposed from the bottom surface portion of the mold member.

(5) An adhering member which allows the bottom portion of the mold member to be adhered to the terminal portion of the antenna is further provided.

(6) The mold member is formed to cover the holding portions and a part of the connection cord.

(7) The mold member comprises a thin-plate bottom portion and a plurality of island portions molded integrally with the bottom portion and spaced at appropriate intervals.

By making the vicinity of the attached portion of the connection cord flexible, it is possible to flexibly disperse and absorb external force exerted on the connection cord during the attachment of the film antenna. Further, by closing at least one of the through-hole and the notch portion after the cut portion of the terminal fixture has been cut, moisture can be prevented from entering the connection terminal unit through at least one of the through-hole and the notch portion. This serves to protect the terminal fixture from rust, a short-circuit, or the like.

A manufacturing method of a connection terminal unit for an antenna, which is used to connect a connection cord to a terminal of an antenna, the connection cord comprising a plurality of conductors concentrically arranged via an insulator, according to a third aspect of the present invention is characterized by comprising:

connecting the connection cord to a terminal fixture having a plurality of holding portions which are formed integrally with the terminal fixture via at least one cut portion and the number of which corresponds to the number of the conductors of the connection cord, the cut portion being cut after the terminal portion has been covered with the mold member, in order to separate the plurality of holding portions from one another; forming a mold member having a thin-plate-like bottom surface portion and a cover portion which are integrally molded, the bottom surface portion extending along a cord length direction of the connection cord, the cover portion cooperating with the bottom surface portion in covering and holding the holding portions, the mold member being formed so that the cut portion is exposed; and cutting said exposed at least one cut portion to electrically insulate the holding portions. The same advantage can be obtained as the connection terminal unit for an antenna according to the second aspect by the manufacturing method.

This manufacturing method of a connection terminal unit for an antenna is preferably configured in the manners shown below. These manners may be individually applicable or any of them may be properly combined together.

(1) The formation of the mold member includes formation of at least one of a through-hole and a notch portion from which the cut portion is exposed.

(2) Forming the mold member in said at least one of the through-hole and the notch portion after the cut portion has been cut is further provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A connection terminal unit for an antenna, which is connected to a connection terminal of the antenna, comprising:

a connection cord that feeds power to the antenna and transmits a signal received by the antenna;

a terminal portion having a first end attached to one end of the connection cord and a second end; and a mold member being formed to cover the terminal portion and a part of the connection cord, wherein the mold member has a thin-plate bottom portion and a plurality of island-shaped portions molded integrally with the bottom portion and spaced at appropriate intervals, and wherein the second end of the terminal portion is exposed from the bottom portion.

2. The connection terminal unit for an antenna according to claim 1, wherein the mold member is made of a flexible insulating resin.

3. The connection terminal unit for an antenna according to claim 1, wherein each of the island-shaped portions of the mold member comprises a half-ring-like shape and is formed to tightly contact with the terminalportion and a part of the connection cord.

4. The connection terminal unit for an antenna according to claim 1, wherein the bottom portion of the mold member is adhered to a connection terminal unit of the antenna, and the second end of the terminal portion is electrically connected to the connection terminal portion of the antenna.

5. The connection terminal unit for an antenna according to claim 1, further comprising an adhering member which allows the bottom portion of the mold member to be adhered to the connection terminal portion of the antenna.

6. The connection terminal unit for an antenna according to claim 1, wherein the island-shaped portions of the mold member formed to cover the terminal portion are set to be longer than the island-shaped portions of the mold member formed to cover the part of the connection cord, along a cord length direction of the connection cord.

7. The connection terminal unit for an antenna according to claim 1, wherein the mold member is formed so as to prevent the one end of the connection cord and the first end of the terminal portion from being exposed.

* * * * *